United States Patent [19]

Kolbl et al.

[11] 4,323,147

[45] Apr. 6, 1982

[54] COIN-OPERATED DISPENSING DEVICE REFLECTING THE SELLING PRICE OF ITEMS TO BE DISPENSED

[75] Inventors: Richard Kolbl; Bernd Mehlan, both of Herrieden, Fed. Rep. of Germany

[73] Assignee: Sielaff GmbH & Co., Fed. Rep. of Germany

[21] Appl. No.: 132,766

[22] Filed: Mar. 24, 1980

[30] Foreign Application Priority Data

Mar. 24, 1979 [DE] Fed. Rep. of Germany ..... 2911634
Apr. 9, 1979 [DE] Fed. Rep. of Germany ..... 2913432

[51] Int. Cl.[3] ..... G07F 5/08
[52] U.S. Cl. ..... 194/48; 194/1 L
[58] Field of Search ..... 194/1 L, 2, 94, DIG. 3, 194/45, 48, 50, 53

[56] References Cited

U.S. PATENT DOCUMENTS 2,993,581 7/1961 Holstein et al. ..... 194/DIG. 3
3,587,805 6/1971 Rowekamp ..... 194/2

FOREIGN PATENT DOCUMENTS 207150 1/1960 Austria .
2644858 1/1980 Fed. Rep. of Germany .

*Primary Examiner*—Stanley H. Tollberg
*Attorney, Agent, or Firm*—McGlew and Tuttle

[57] ABSTRACT

A coin operated dispensing arrangement in which a plurality of counting cams can be set to reflect the selling price of items to be dispensed. These cams are rotated in response to the insertion of coins into the device, and a blocking rod is movable from a normal blocking position to a release position which permits dispensing of selected items in response to the insertion of coins having a value corresponding to the selected selling price. A plurality of movable sensing members cooperate with the cams, and a slide member holds normally the blocking rod in the blocking position, while being movable to a disengaging position by any one of the sensing members. A plurality of control levers are pivotable in front of the slide member into and out of the path of movement of respective sensing members.

10 Claims, 6 Drawing Figures

4
5
38
45
43
42
41
44
3
2
39
6
38
39
40
37
35
1
34
36
37
31
33
8
7
32
12
13
17
31
14
18-21
16
9
15
22
R
28'
24
67
72
23
28''
29
56
63-66
57
31
30
59
68,69
58
28
70,71
51
29
62
60
74
48
27
V
V
61
46
88
47
87
26
54
89
25
52
79
86
83
82
80
III
III 2
1
8
10
11
9
12
13
14
15
7
18
19
20
21
31
17
16
24
23
67
58
57
62
24
63
64
61
28
56
65
66
30
68
69
70
27
27
46
71
74
50
47
49
51
48
P
52
54
26
82
81
83
85
84

COIN-OPERATED DISPENSING DEVICE REFLECTING THE SELLING PRICE OF ITEMS TO BE DISPENSED

BACKGROUND OF THE INVENTION

The present invention relates to a coin-operated dispensing device, and more particularly to a control arrangement for a coin-operated dispensing device having a coin counter with cams which can be adjusted to different sales prices and are advanced in rotation in accordance with the monetary values of the coins deposited in the device.

Coin operated dispensing devices are known which have control arrangements utilizing electric means which serve to associate the different sales prices counted up by the counter for inserted coins, with the goods of different dispensing parts of the device. Customarily, so-called crossed bars distributors are used for this purpose. Control devices of this type require a large number of electromechanical switching elements and must under all circumstances be connected to a source of electrical energy.

A different type of arrangement is described in German Published Application No. 26 44 858. This device includes a coin sensing arrangement of a mechanical dispensing device, in which the sales prices can be adjusted for different values in a simple manner. An association of different sales prices to different dispensing components of the dispensing device is possible if separate inlet ducts are used for coins having different values, and if these are user-selectable by means of two control rods which can selectively be coupled with the dispensing components. In the case of dispensing devices having a coin counter, this type of equipment cannot be used because the determination of coin value and of the question whether the coins are genuine or are slugs is carried out in passages. A coin counting device of this type is described in Austrian Patent

SUMMARY OF THE INVENTION

Inasmuch as none of the coin-operated dispensing devices known from the prior art are entirely satisfactory, it is an object of the present invention to provide improvements over the state of the art.

A more particular object of the invention is to provide a coin-operated dispensing device having a control arrangement which permits, with the aid of purely mechanical means, an association between sales prices set by the user for different dispensing components of the dispensing device, and the coins counted up by the coin counting device.

In pursuance of the above objects, and of others which will become apparent hereafter, one aspect of the invention resides in a coin-operated dispensing device of the type having a plurality of counting cams which can be set to reflect the selling price of items to be dispensed and which are rotated in response to the insertion of coins into the device. Control rods (one or more) for setting the selling price of the desired items are provided, and a dispensing device is provided for the selected items. A blocking rod is movable from a normal blocking position to a release position permitting dispensing of the selected items in response to the insertion of coins having a value corresponding to the selected selling price. In such a coin-operated dispensing device the invention provides a plurality of movable sensing members each cooperating with one of the cams, a slide member normally holding the blocking rod in the blocking position and being movable to a disengaging position by any one of the sensing members, and a plurality of control levers each connected with one of the control rods and being pivotable thereby in front of the slide member into and out of the path of movement of a respective one of the sensing members.

If a single control rod is provided, then two different selling prices can be selected. Accordingly, a coin counting device having two movable cams is to be used. Depending on whether the control rod is so coupled with one of the dispensing components of the device that at the beginning of operation of one of the dispensing components, it tilts or does not tilt, the dispensing component is associated to one or the other selling price. In dispensing components of this type, which are intended for the lower of the selling prices, the control rod is not coupled therewith so that the control rod does not pivot into the path of movement of the sensing member. As soon as the sensing member engages the cam associated with the lower selling price, the slide member releases the dispensing component for dispensing of the selected (and paid-for) item.

In the case of dispensing components which are associated with the higher selling price, the control rod pivots permitting the associated control lever to move into or out of the path of movement of the sensing member associated with the lower selling price, so that via the same the dispensing component remains blocked as long as the coin counting arrangement has counted only coins corresponding to the lower of the two selling prices.

The control device is preferably used if more than one control rod is provided. If n-control rods are used, then $2^n$-sensing members and $(2^n-1)$ control levers are to be provided. Entraining members are provided on some of the control levers which engage and entrain other control levers to move them to their blocking position. The coupling of the control levers by means of these engaging members is effected in such a manner that the control levers associated with the lower selling prices pivot into or out of their blocking position if control rods associated with higher selling prices are actuated via the item dispensing components.

According to a currently preferred embodiment of the invention, two control rods are provided, four sensing members and three control levers, and the control lever which is associated with the sensing member for the lowest selling price is entrained and taken along via entraining members when the control lever associated with the next higher selling price is pivoted, as well as when the control lever associated with the second higher selling price is pivoted.

According to a further concept of the invention, a pawl is provided which is pivotable by the blocking rod and which has a supporting surface facing the sensing members and control edges facing the blocking rod. The supporting surface holds the sensing members away from the cams as long as the blocking rod is not actuated. In this manner, the sensing members are out of engagement with the cams while the same are being rotated. Thus, no frictional forces occur between the sensing members and the cams which would have to be overcome by the coin counting arrangement. This is particularly advantageous if the coin counting arrangement operates with a mechanical energy storing device.

Another concept of the invention provides for one of the control edges of the pawl to pivot the pawl after the blocking rod has moved through part of its stroke, namely through a testing movement, so as to lift the sensing members off the cams. The sensing members thus can engage the cams only if the blocking rod travels through the testing path. After the testing path, the sensing members are lifted off the cams again, so that during re-setting of the coin counting arrangement which takes place during the further movement of the blocking rod, the sensing members no longer contact the cams and the re-setting of the coin counting arrangement requires only the exertion of a small amount of force.

The supporting surface of the pawl holds the sensing members out of contact with the control levers also, as long as the blocking rod is not actuated. The control levers must not move the sensing members while they themselves are adjusted. Only when the supporting surface releases the sensing members will these be able to engage any control levers which are located in their own path of movement. The control levers may, in their rest position, be located outside the path of movement of the sensing members. In this case, it is necessary to assure that the respective control levers are pivoted into the path of movement of the sensing members before those are released by the pawl to such an extent that they in turn release the blocking rod. A more simple solution might be to so construct the control levers that in their rest position they are located in the path of movement of the sensing members. The control levers are, in this event, pivoted out of the path of movement of the sensing members in dependence upon the respective coupling of the control shafts.

The invention provides a coin counting arrangement which works with a mechanical energy storage device and in which purely mechanical means assure an exact advancement of the counting device in correspondence with the respectively inserted coin. This device may, according to a further concept of the invention, be provided with blocking or retarding anchors each of which has a blocking wheel associated with it, and may have at least one mechanical energy storing device engaging the blocking wheels. The release levers may be coupled by means of transmissions with the summing shaft and the transmission ratios in the transmissions of the blocking anchor to the summing shaft may have relationships relative to one another corresponding to the relationships of the values of coins which are acceptable in the dispensing device. An energy producing device may be coupled with the mechanical energy storage device to supply energy to the same. The energy necessary for advancing (stepping) the advancing arrangement and the control device may be stored in the mechanical energy storing device which stores energy when one of the dispensing components of the coin-operated dispensing device is operated. Such energy storage devices are known, for example, from mechanical clockworks.

In addition, the invention assures that each coin of a particular coin value advances the associated blocking wheel via the respective retarding anchor and the associated release lever only by a single step. The differential setting of the counting device corresponding to differential coin values, is obtained by a fixed transmission ratio.

According to a currently preferred embodiment, the summing shaft fixedly carries a counting wheel with an indicating drum and with cams which can be rotatably adjusted. The blocking wheels are coupled with the counting wheel via appropriate gears. The transmission ratios of the blocking wheels and the gears in the gear transmissions are selected in accordance with the relationships of the coin values of coins acceptable to the coin-operated dispensing device. By appropriate selection of the transmission of the gears, identical blocking wheels may be utilized. Blocking wheels with different numbers of teeth can also be employed in the transmissions.

The construction of the arrangement according to the present invention is particularly simple if only a single gear common to all of the gear transmissions, engages the counting wheel.

A single mechanical energy storing device may be used which acts upon the blocking wheels respectively the gears of all of the gear transmissions. However, each gear transmission may have its own energy storing device, if desired.

The coin counting arrangement can be utilized not only with purely mechanical coin-operated dispensing devices. It can be used to advantage also with other dispensing devices having electromechanical dispensing components, since the coin counting device herein disclosed is less complicated, therefore less expensive and less subject to malfunction, than electromechanical coin counting devices.

The invention will hereafter be described with reference to exemplary embodiments. It is to be understood, however, that these will serve only for purposes of explanation and are not to be considered limiting in any sense.

DESCRIPTION OF PREFERRED EMBODIMENTS

Figure 1:
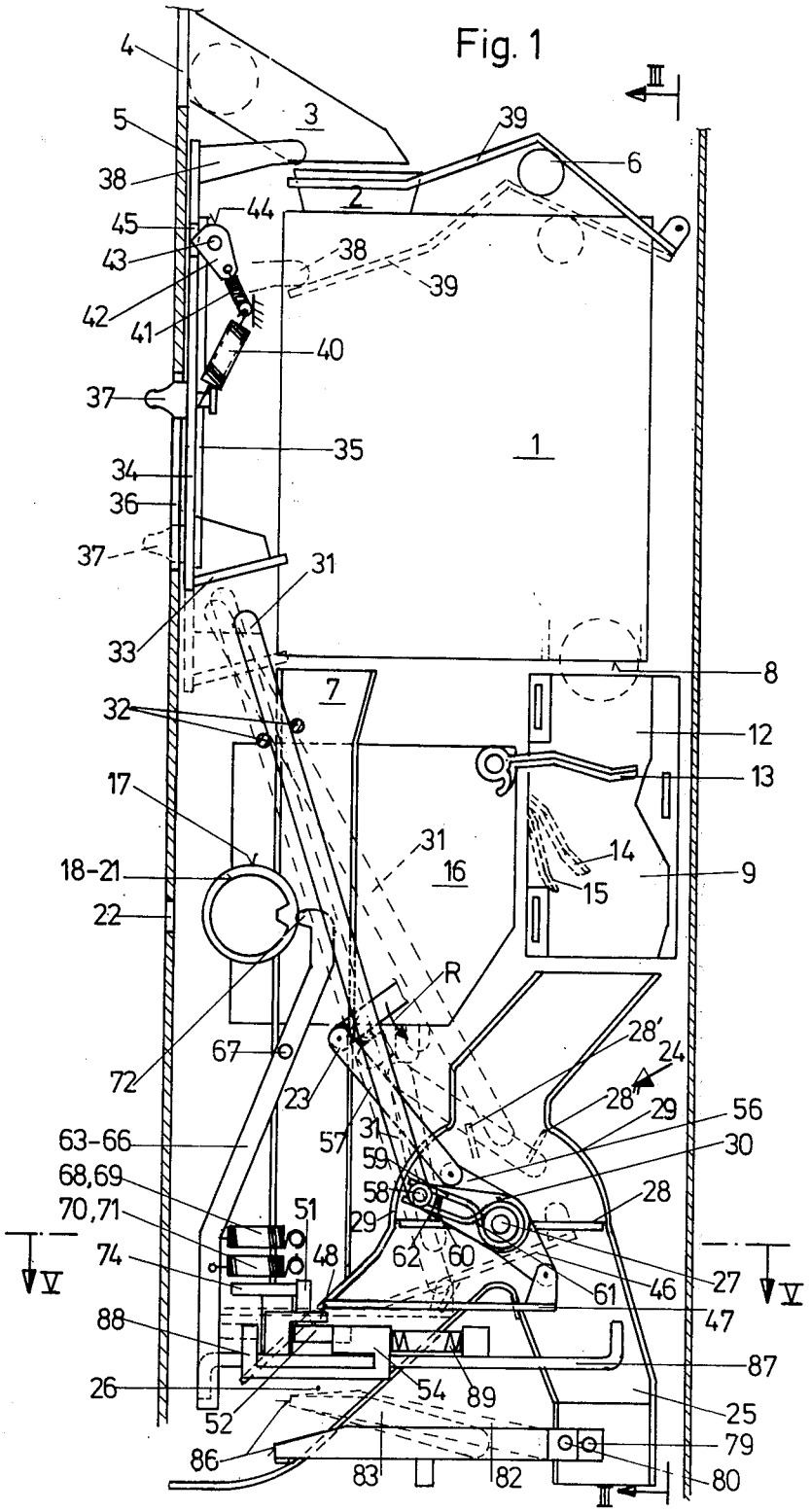
FIG. 1 is a side view, partly sectioned, showing details of a coin-operated dispensing device according to the present invention.

Referring firstly to FIG. 1, it will be seen that a coin-operated dispensing device according to the present invention, in which the item dispensing components may for example be in form of push-buttons or small drawers to be pulled out (neither illustrated because known per se) has a coin tester 1 which tests the coins to determine whether they are genuine or counterfeit. Such devices are known per se in the art and require no detailed description. An inlet funnel 2 of the coin tester 1 is connected via an inlet channel 3 to a coin slot 4 formed in the front panel 5 of the dispensing device. The coin tester 1 has a pin or projection 6 and opens up when the projection 6 is tilted, so that counterfeit coins can drop into a counterfeit coin channel 7. In addition, the tester 1 has three coin outlet slots 8 each of which is associated with a particular coin value, for example, for dimes, quarters and dollars.

Three chambers 9, 10 and 11 of a coin channel 12 communicate with the outlet slots 8. Into each of these chambers 9–11, a pivotable lever 13, 14 and 15 of a coin counting device 16 extends which can be pivoted by contact with a coin. Each pivoting of one of the levers 13–15 advances an indicating row 17 and cams 18–21 by an angle corresponding to the respective coin value. The instantaneous position of the indicating row 17 is readable through a window 22 in the front panel 5 of the dispenser. The cams 18–21 can be manually turned relative to the indicating row or drum 17. By selecting an appropriate turned position relative to the drum 17 these cams 18–21 are set to a certain sales price by the person tending the coin operated dispensing device. A resetting lever 23 is provided on the coin counting device 16 by means of which the drum 17 and the cams 18–21 can be returned to their starting position. Coin counting devices for this same purpose are already known as electromechanical devices, a purely mechanical counting device for the purposes of the present invention is described later on with reference to with FIG. 6.

A coin distributor 24 is located downstream of the coin channel 12 and can communicate both with a collecting channel 25 and with a coin return channel 26. A shaft 27 is channeled on the distributor 24 beneath the channel 12, intermediate the channel 25 and channel 26. A flap 28 is mounted on the shaft 27 in such a manner that the shaft 27 is located at the center of the flap 28. The wall 29 of the device 24 is shaped above the flap 28 to follow a portion of arc, so that in all positions of the flap 28 a tight contact of the flap with the wall 29 is assured. The space above the flap 28 is sufficiently large so that a relatively large number of coins can be temporarily stored on the flap without any difficulties (compare FIG. 2). The figures show the flap 28 in its rest position and its collecting position and its coin return position are both shown in chain lines and identified with reference numerals 28' and 28'', respectively. In the coin return position, the flap 28 closes both the channel 25 and the channel 26. All coins which have passed through the tester 1 first drop onto the flap 28 on which they become collected without any danger that the flap might become blocked. If it is desired that the coins be sorted according to coin values and directed into the collecting channel 25, then separating or dividing walls 28 may be provided on the flap 28 for this purpose. In this case, each coin value has its own channel between the slots 8 and a collecting chamber which is not separately illustrated.

An eccentric 30 is mounted at one end of the shaft 27 and a push rod 31 is connected to it. The push rod 31 is tiltable between two bolts 32 above the coin counter 3 and is slidably mounted. Opposite the free end of the push rod 31 is a press member 33 which is secured to the lower end of a slidable plate 34 located at the inner side of the front plate 5 between guide rails 35. The plate 34 is slidable by means of sliding handle 37 which extends through a slot 36 of the front panel 5. The length of the slidable plate 34 is more than double that of the slot 36, so that the plate covers the slot 36 from the inside irrespective of the extent to which the plate has been shifted relative to the slot 36.

An arm 38 is connected to upper end of the plate 34 and associated with a pivotable lever 39 which extends over the pin 6 of the coin tester 1. A contraction spring 40 pulls the plate 34 into its uppermost position. A device to block the reversing movement of the plate 34 is provided, consisting of a tilt member 42 which is biased by a spring 41 and which has a cam track 44 extending spirally to a journal pin 43. When the plate 34 is in its upper end position, the member 42 extends into a cutout or recess 45 of the plate 34, the purpose being to prevent the plate 34 from being pushed up unless the member 42 can extend over the upper free end of the plate 34. The lower position of the plate 34 with handle 37, arm 38, lever 39 and member 33 is shown in broken lines in FIG. 1.

Figure 2:
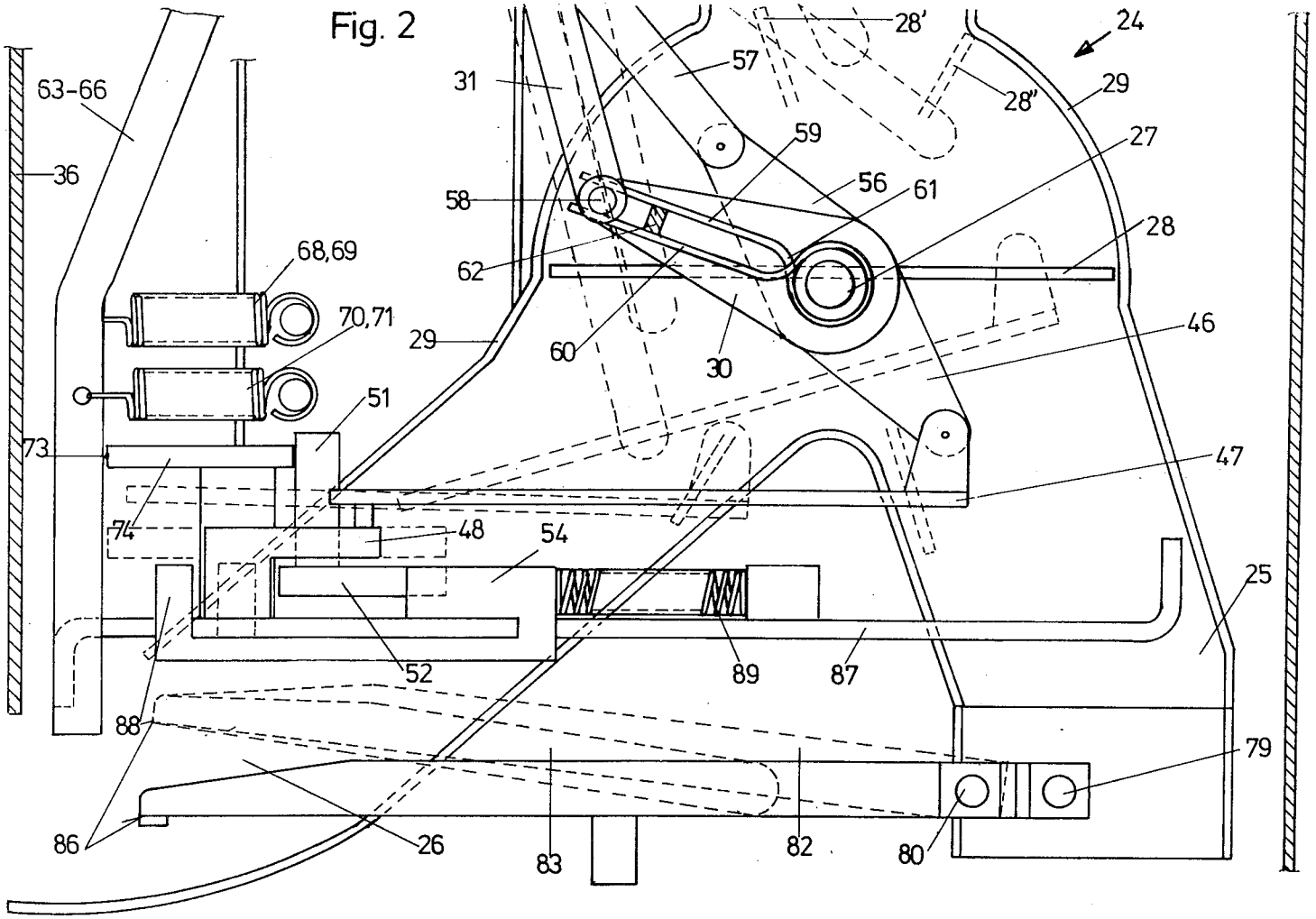
FIG. 2 is a fragmentary enlarged view, showing a detail of FIG. 1.
Figure 3:
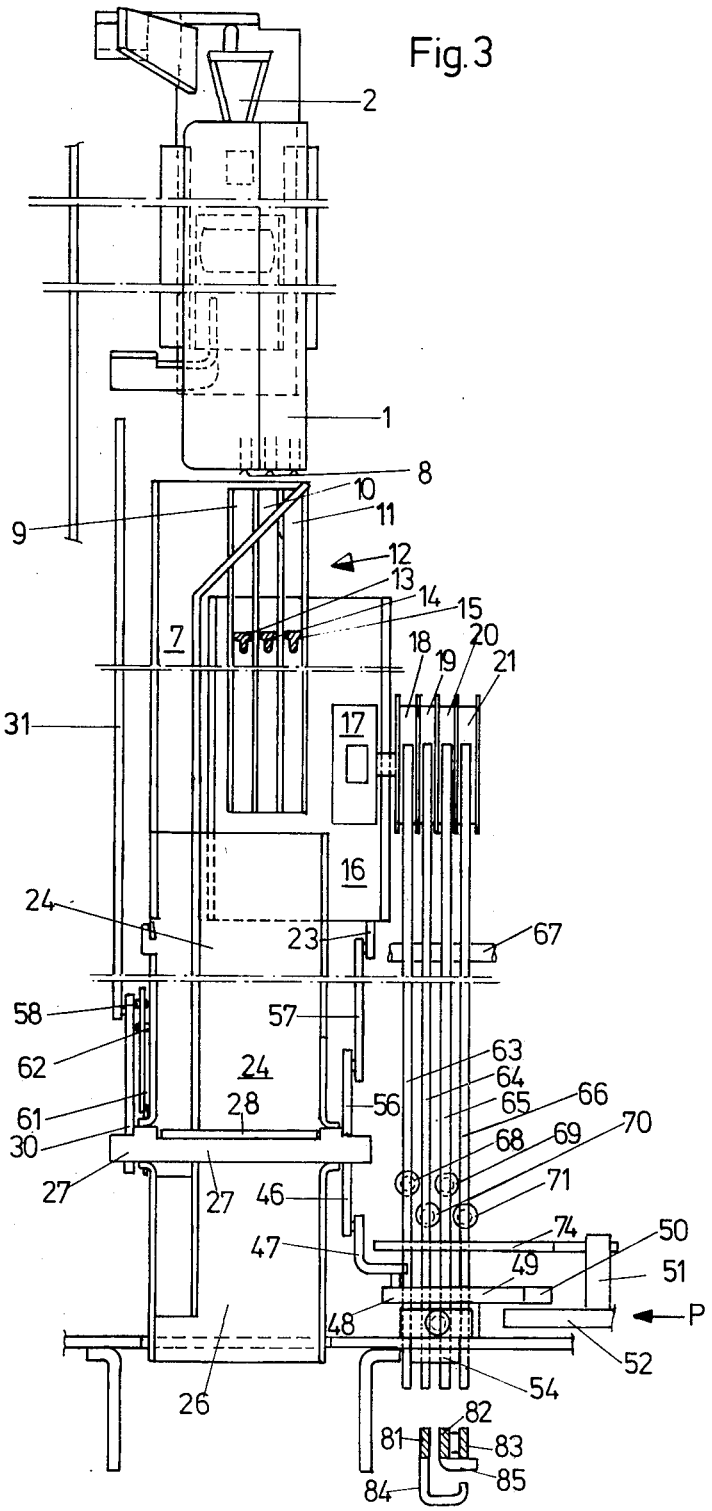
FIG. 3 is a detailed view, taken on line III—III of FIG. 1.
Figure 4:
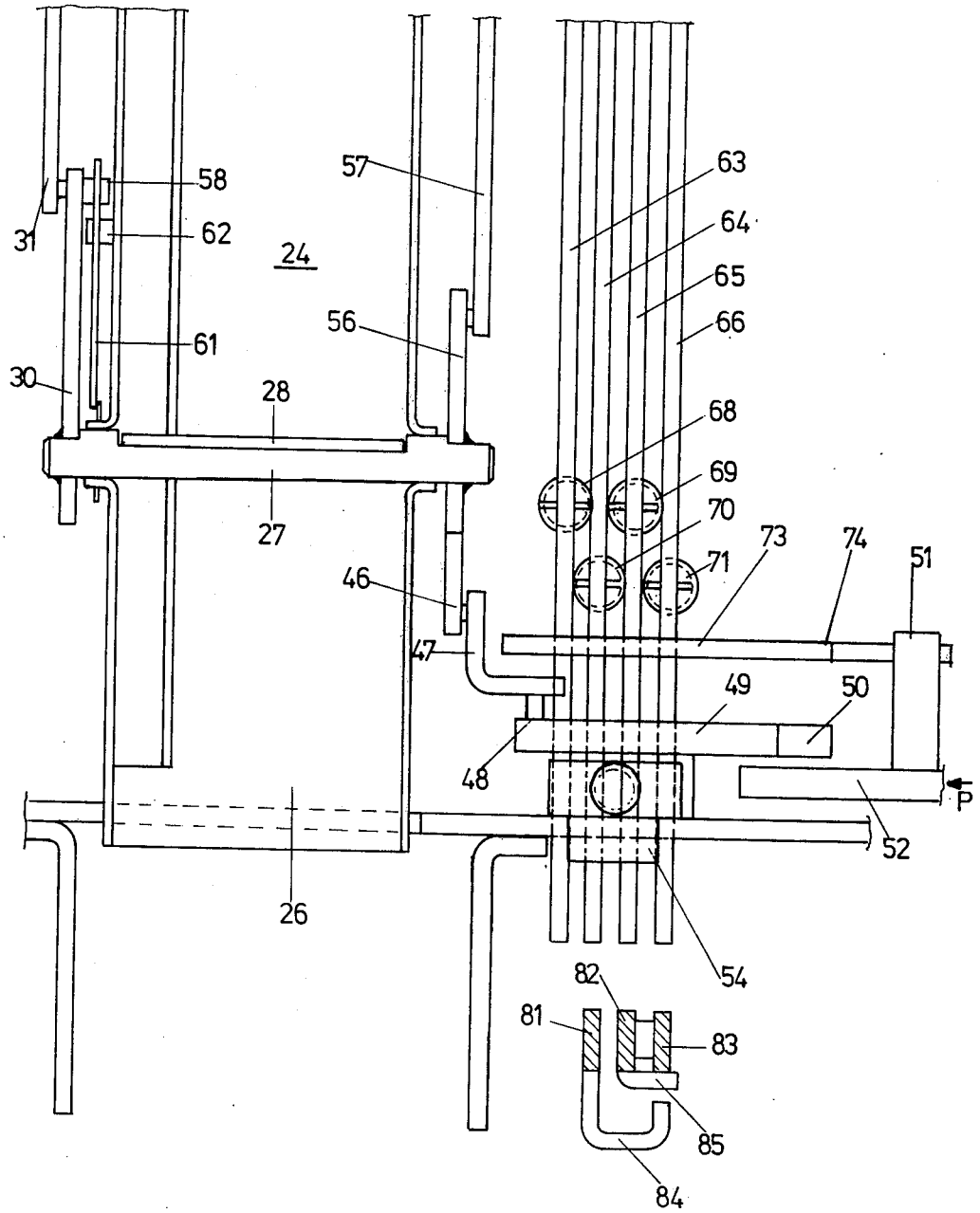
FIG. 4 is an enlarged fragmentary detailed view corresponding to FIG. 3.

Another extender 46 is secured to the shaft 27 at the end remote from the eccentric 30. FIG. 2 shows particularly clearly that the eccentric 46 is shorter than the eccentric 30. One end of a coupling rod 47 is connected to eccentric 46, the other end being journaled in an arm 48 of an anchor lever 49. Another arm 50 of the lever 49 is located in the path of movement of a bolt 51 of a blocking rod 52. The lever 49 is pivotable about a stationary axis 53. Blocking rods as the rod 52 are known and so is their function. The rod 52 is coupled with all dispensing components such as push buttons or small drawers which are to be pulled, in such a manner that the blocking rod 52 is shifted in the direction of the arrow P if an attempt is made to operate one of the dispensing components. In each instance—even if coins have been inserted which are sufficient to amount to the sales price required to dispense an item—the blocking rod 52 and thus the bolt 51 are displaced through the testing distance A. The arm 50 of the lever 49 is so arranged that the bolt 51 engages it only when the end of the testing distance A has been reached. A blocking slide 54 is located spaced from the testing distance A, as seen in the direction of movement P of the rod 52. The slide 54 blocks any movement of the rod 52 going beyond the testing distance A, so long as the dispensing device detects the present of a number of coins insufficient to make up the required selling price. The slide 54 is moved out of the path of movement of the rod 52 once a sufficient number of coins has been sensed. This will be described in more detail below. An abutment 55 supports the slide 54.

A third eccentric 56 is also mounted on the shaft 27, forming together with a drive rod 57 that is pivoted to it and whose free end remote from the eccentric 56 is connected to the resetting lever 23, a lever drive which in the rest position of the flap 28 is in dead center position as shown in FIG. 2. This means that both a turning of the shaft 27 in clockwise direction and a turning of the shaft 27 in anti-clockwise direction, causes the resetting lever 23 to move in the direction of the arrow R. A pin 58 provided at the free end of the eccentric 30 is engaged by two brackets 59 and 60 of a spring 61 which surrounds the shaft 27. The brackets 59 and 60 both engage a stationary abutment 62 when the flap 28 is in rest position.

FIG. 2 shows particularly clearly that the eccentrics 30, 46 and 56 are offset relative to one another and relative to the flap 28. The position of the eccentrics 30 and 46 is so selected that when the flap 28 is to be moved out of its rest position by them, mechanically advantageous conditions are obtained.

The hereinbefore described collecting arrangement operates essentially in the following manner:

Coins inserted through the coin slot 4 are tested in known manner in the coin tester 1. Genuine coins operate in the chambers 9, 10 or 11, the respective lever 13, 14 or 15 and in consequence are allowed to drop onto the flap 28. Counterfeit coins or slugs pass through the channel 7 directly into the return channel 26. All proper coins inserted for a particular dispensing incident are thus first collected in the device 24. The person attempting to operate the dispensing device can tell, from viewing the indicating drum 17, whether the device 24 already has collected sufficient coins to make up the selling price of a selected item. In any case, the purchaser has the possibility to remove the already inserted coins from the channel 26 by operating the handle 37 so long as none of the dispensing components (e.g., push buttons) has been activated far enough for the rod 52 to move beyond the testing distance A. If the handle 37 is pushed downwardly, the arm 38 tilts the lever 39 so that the device 1 is opened via the pin 6, permitting coins located in the device 1 to travel through the channel 7 back into the coin return channel 26. During the operation of the handle 37, the rod 31 is pushed downwardly, crossing the eccentric 30 to be pivoted in counter-clockwise direction and to tension the spring 61 via the pin 58 and the bracket 60, with the result that the flap 28 is so tilted that coins located on it fall into the return channel 26. At the same time, the eccentric 56 and the rod 57 pivot the resetting lever 26 of the coin counting device 16 in the direction of the arrow R, in such a manner that the drum 17 and the cams 18–21 return to their starting positions. The reverse movement blocking device 41–44 prevents the coins from sliding off the flap 28 into the channel 26 without a complete resetting of the counter 16. The eccentric 46 with the rod 47 and the angled lever 49 is entrained during the pivoting of the eccentric 30 via the rod 31.

The spacing shown in FIG. 1 between the upper end of the rod 31 and the member 33 in the rest position permits a partial opening of the coin tester 1 via the arm 38 and the pivot lever 39 before shifting of the rod 31 takes place. Thus, coins which may be retained in certain parts of the tester 1 can be discharged into the channel 7 without returning valid coins having been collected in the device 24 and thus forcing the potential customer to reinsert these valid coins. Once the handle 37 is released, after having been pulled all the way down, the spring 40 pulls the plate 34 back to its uppermost position. The flap 28 is tilted back to its rest position by the previously tensioned bracket 60 of the spring 61. The abutment 62 predetermines the rest position of the flap 28 exactly. Coins dropping into the device 24 cannot displace the flap 28 from its rest position because they contact the flap 28 at its center, i.e., where the shaft 27 is located.

Assuming that the potential purchaser operates one of the dispensing components, for example, a push button or pull-type drawer associated with one of the dispensing chutes of the coin operated dispenser, and if sufficient coins are collected in the device 24 to correspond to the selling price of the particular item, then the slide 54 moves out of the way, permitting the rod 52 to move beyond the testing distance A, as will be described later. During this movement, the bolt 51 abuts the arm 50 of the lever 49. The arm 48 pulls the coupling rod 47 so that the eccentric 46 is tilted in clockwise direction. This causes the eccentric 30 and the rod 31 to be taken along and the system comprised of the eccentric 30 and the rod 31 with the bolt 32 moves passed a dead center position, and once the dead center position is exceeded pressure upon the handle 37 results in a movement of the flap 28 in clockwise direction, i.e., effecting collection of the coins. The pivoting of the eccentric 46 in clockwise direction causes via the eccentric 56 and the rod 57 a pivoting of the resetting lever 23 in the direction of the arrow R. When the flap 28 reaches the collecting position 28', the coins have dropped into the collection box of the device and the counter 16 has returned to its rest position.

Once the operated dispensing component (e.g. push button) is released again, the rod 52 and the bolt 51 move back. The bracket 59 of the spring 61 which has been tensioned by the pivoting of the eccentric 46, causes the eccentrics 30, 46, 56 and the flap 28 to return to their respective rest positions.

As mentioned earlier, three cams 18–21 are provided in the exemplary embodiment being described. Each of these has a sensing lever 63–66 associated with it. The levers 63–66 are mounted on a shaft 67 and are so biased by respective springs 68–71 that noses 72 of the levers 63–66 are being pushed in direction towards the cams 18–21. The levers 63–66 engage a supporting surface 73 of a pawl 74 under the force of the springs 68–71, so that in the illustrated position of the pawl 74 (see FIGS. 1 and 5) these noses 72 cannot press against the cams 18–21. The pawl 74 is provided with control edges 75–78 which are associated with the bolt 51 (see FIG. 5). When none of the dispensing components (e.g. push buttons) is operated, the control edge 75 engages the bolt 51. The levers 63–66 are being held by the surface 73 in a position in which their noses 72 cannot engage the cams 18–21.

The dispensing components are provided with an arrangement for setting multiple prices. In the exemplary embodiment, two control shafts 79 and 80 are provided for this purpose which are common to all dispensing components. The individual dispensing components can be so coupled to the control shafts that on operation of one of the dispensing components, depending upon the selected coupling, one of the two control shafts, none of the two control shafts or both control shafts together are turned. A control arm 31 is provided at the end of the control 79, and a similar control arm 82 at the end of the shaft 80. In addition, a freely pivotable control shaft 83 is provided. Entraining members 84 and 85 for the lever 83 are provided on the shafts 79 and 80. If none of the shafts 79 and 80 are turned, the levers 81, 82 and 83 are positioned in the solid-line positions shown in FIG. 1. If one of the control shafts 79 or 80, or if both of the control shafts 79 and 80 are turned by operation of one of the dispensing components, then the free ends 86 of the levers 81 and/or 82 and of the lever 83 extend into the path of movement of the lower ends of the levers 64 and 66 respectively the levers 65 and 66 or the levers 64, 65 and 66. FIG. 2 shows the levers 82 and 83 in raised position, i.e., in a position in which they extend into the path of movement of the levers 65 and 66; this raised position is illustrated in broken lines.

Figure 5:
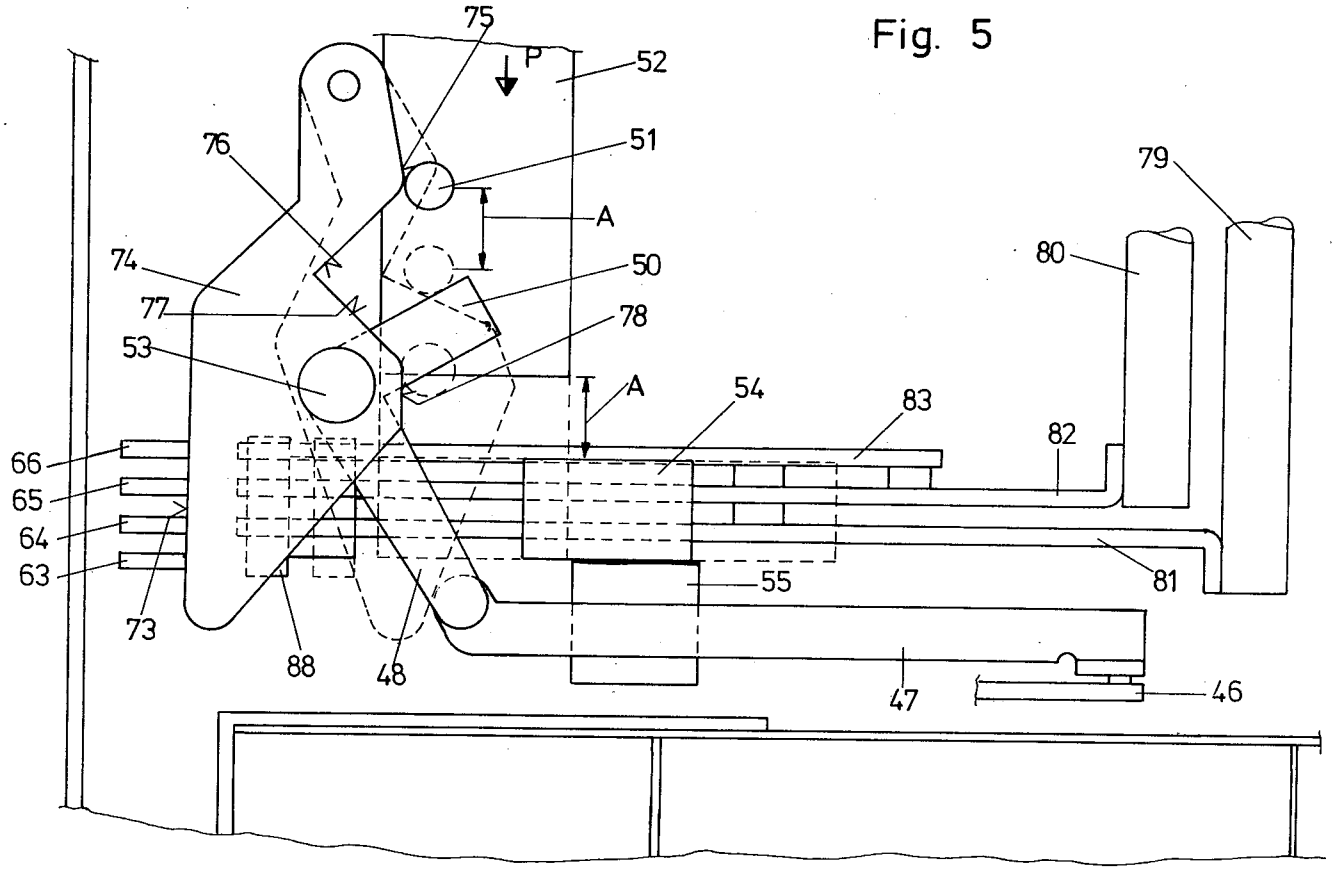
FIG. 5 is a top view as seen in the direction of line V—V of FIG. 1.

The slide 54 is guided on a plate 87 and is provided with an operating part 88, the distance between the part 88 and the slide 54 being so chosen that in the release position of the slide 54 the rod 52 can pass between the part 88 and the slide 54. A spring 89 maintains the slide 54 at its blocking position. The width of the part 88 is so chosen, as shown in FIG. 5, that each of the levers 63–66 can abut against the part 88.

The operation of the device described immediately preceding, is substantially as follows:

If one of the dispensing components is operated—either without deposition of coins or after the deposition of coins—then the rod 52 shifts and with it the bolt 51 shifts through the distance A. The control edge 75 of the pawl 74 is thereby released. The supporting surface 73 of the pawl 74 releases the levers 63–66 which pivot under the influence of the springs 68–71 in the direction of the part 88. Assuming that all levers 81, 82 and 83 are in raised position, the levers 64, 65 and 66 abut against the levers 81, 82 and 83; they cannot act upon the part 88 because the free ends 86 of the levers 81, 82 and 83 extend slightly beyond the part 88 and thus prevent the actuation of the same by the levers 64, 65 and 66. At the same time, these levers are still maintained at a slight distance from the associated cams 18–21. Only the lever 63 abuts against its associated cam 18. As soon as the nose 72 of the lever 63 enters into the recess of the cam 18, the lever 63—actuated by the spring 68—acts upon the part 88 and shifts the slide 54. This permits the dispensing of an item of goods from the operated dispensing component. The nose 72 of the lever 63 drops into the recess of the cam 18 after the counter 16 has counted a coin value corresponding to the selling price of the item to be dispensed by the particular dispensing component. The coupling of this dispensing component is so effected that both control shafts 79 and 80 are actuated. The cam 18 associated with the lever 63 is of course to be preset for the highest selling price.

During the operation of the dispensing component, the bolt 51 slides along the control edge 77 of the pawl 74, until the control edge 78 of the pawl 74 abuts the bolt 51. All levers 63–66 are now again lifted off the cams 18–21. During the restoring movement of the bolt 51 the levers 63–66 may at most briefly abut against the cams 18–21, until the control edge 75 of the pawl 74 is again supported by the bolt 51. In all circumstances in which the deposition of coins and thus an advance of the cams 18–21 of the counter 16 is to be expected, the levers 63–66 do not engage the cams so that no frictional forces causes by these levers need to be overcome by the coin counter.

Appropriate coupling of the dispensing components with the two shafts 79 and 80 in the exemplary embodiment, permits the selection of four different selling prices. Accordingly, the four cams 18–21 are provided with which the respective selling price is to be preset. The necessary association of the four selling prices is effected via the levers 81, 82 and 83. For the highest selling price, operation of the dispensing component associated with the goods being sold at the highest price causes the levers 81, 82 and 83 to be raised via the shafts 79 and 80, as already described hereinbefore. Thus, when the counter is set for the highest selling price, none of the levers 64, 65 and 66 can engage the associated cams 18–21, so that a shifting of the slide 54 is avoided in the event an insufficient coin value has been inserted into the dispenser.

In the case of dispensing components which are associated with the lowest selling price, shifting of the bolt 51 through the distance A, during which otherwise raising of the levers 81, 82 and 83 takes place, none of these levers is raised. All four of the levers 63–66 now abut the cams 18–21. As soon as the lever 66 enters into the recess of the associated cam 21, it shifts the slide 54 via the part 88, counter the force of the spring 89, and the device associated with the lowest-price item can now be further operated to effect dispensing of the item. Another dispensing component which is set for a higher selling price cannot be actuated under these conditions because this is prevented by the rod 52.

Corresponding factors operate in the case of the two intermediate prices, i.e., the ones between the highest and the lowest price. In this case the levers 56 and 66 or 64 and 66 are blocked via the levers 82 and 83 or else the levers 81 and 83. The coin value counted by the counter 16 cannot lead to a movement of the slide 54, as long as this coin value is below the required selling price.

The relationships of the control functions are shown in the following table:

| | | | | | | |
|---|---|---|---|---|---|---|
| Control shaft | 79 | — | x | — | x | |
| Control shaft | 80 | — | — | x | x | |
| Control shaft | 81 | — | x | — | x | |
| Control shaft | 82 | — | — | x | x | |
| Control shaft | 83 | — | x | x | x | |
| | | 1. | 2. | 3. | 4. | Selling price |

The table shows, for example, that when the shaft 79 is turned and the shaft 80 is not turned, the levers 81 and 83 are raised. This prevents the levers 64 and 66 from engaging the associated cams 19 and 21, respectively. As soon as sufficient coin value has been counted to make up the second selling price, the lever 65 can engage the associated cam which has been set for the second selling price. Corresponding circumstances apply to the other positions.

The invention embraces many other possibilities. For example, the sliding plate with the sliding handle for the coin return can be replaced with a conventional push button which is known from coin operated dispensing devices. The control can be extended so that more than four selling prices can be selected and set. For example, three control shafts would permit the setting and selection of eight different selling prices, but of course it would then be necessary to provide eight of the sensing levers also.

In the exemplary embodiment the control levers may first be raised during the movement of the blocking rod through the distance A and thereupon the sensing levers be disengaged from the pawl 74. If it is to be expected that one of the sensing levers which is not to engage the part 88, might in fact abut against the part 88 before the control lever associated with it has moved to raised position, then the control levers 81–83 respectively the shafts 79 and 80 may be so constructed that the control levers are located in the path of movement of the sensing levers in their starting position and are lowered by the control shafts upon the respective setting. This assures that no sensing lever can engage the part 88 before the control levers have moved to the necessary position. In addition to the pawl 74 a further pawl may be provided having a control edge which pivots the control levers in a sense opposite to the pawl 74.

Figure 6:
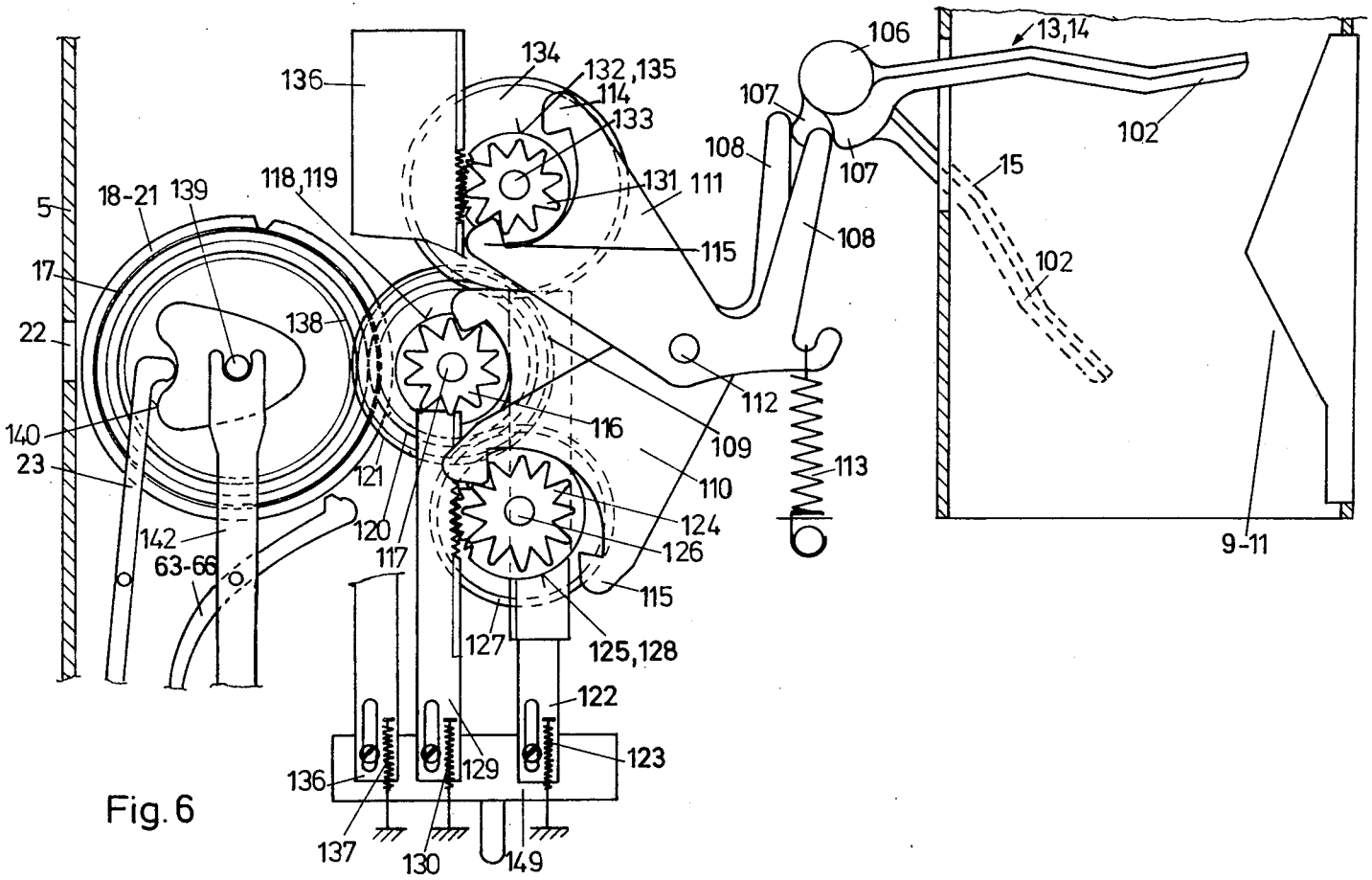
FIG. 6 is an enlarged detailed view illustrating a mechanical coin counting arrangement according to the invention.

Turning now to FIG. 6, it will be understood that the coin counter 16 therein is operated by the inserted coins via the levers 13, 14 and 15. A long lever arm 102 of each of the levers 13–15 extends into the respective chambers 9, 10 or 11. The levers 13–15 are pivotably mounted on a shaft 106 and have short lever arms 107. A free end of a blocking anchor 109, 110 or 111 is located in the path of movement of each of the short lever arms, the free end being designated with reference numeral 108. The anchors 109, 110 and 111 are pivotably mounted on a shaft 112. They are biased by means of springs 113 and each of the anchors 109–111 has, in the usual manner known per se from the art, two hooks 114 and 115 provided on it.

A wheel 116 is associated with the anchor 109 and is mounted on a shaft 117. In addition, the shaft 117 carries for rotation with it a drive wheel 118 and an over-running clutch 119. A gear 120 is turnably journaled on the shaft 117 and a further gear 121 is turnable with the gear 120. The over-running clutch 119 operates between the gears 118 respectively the wheel 116 and the gear 120 in such a manner that it transmits only a relative movement in one direction. The over-running clutch may be provided with axial sawtooth-shaped teeth for this purpose. The gear 118 is subjected to the force of an energy storage device which may, for example, be in form of a rack 122 which is biased by a spring 123.

A wheel 124 is associated with the anchor 110 and is seated, together with a wheel 125, on a shaft 126. A gear 127 is journaled on the shaft 126 and another over-running clutch 128 of the type described before is interposed between the gear 127 and the gear 125 respectively the wheel 124. Gear 127 meshes with gear 120. Gear 125 is subject to the force of an energy storage device, for example another rack 129 which is biased by a spring 130.

Finally, the anchor 111 has associated with it a wheel 131 which is mounted on a shaft 133 together with a gear 132. Another gear 134 is journaled on the shaft 133. An over-running coupling 135 of the type already described is interposed between the gear 134 and the gear 132 respectively the wheel 131. Gear 134 meshes with gear 120. Gear 132 is subject to the force of an energy storage device, which may be in the form of a rack 136 biased by a spring 137.

The gear 121 engages a counting wheel 138 which is mounted on a summing shaft 139. A heart shaped cam curve 140 is provided on the counting wheel 138 and has associated therewith the resetting lever 123. The wheel 138 can be uncoupled from the gear 121 via a coupling lever 142 and reaching the summing shaft 139. The indicating drum 17 is also mounted on the summing shaft 139 and is provided on its outer circumference with appropriate indicia (e.g. monetary values) which can be observed through a window 22 in the front panel 5 of the coin operated dispensing device.

Also mounted on the summing shaft 139 are the cams 18–21 mentioned previously. These can be adjusted relative to the summing shaft 139 with respect to the angular position of their lobes 141. Each of the cams 18–21 is associated with one of the levers 63–66, respectively. To cause the energy storing devices (e.g., racks 122, 129, 136) to store energy in their springs 123, 130 and 137, a slide 49 is provided which, when one of the dispensing components is operated, causes the energy storing devices to store energy. In addition, the resetting lever 23 and the coupling lever 142 are coupled with the dispensing components (e.g. the slidable doors or the push buttons). In the case of mechanical coin operated dispensing devices, the coupling of the lever 23, the lever 142, the slide 149 and the levers 63–66 may be effected with appropriate lever transmission, i.e., to obtain the desired mechanical advantage. In the case of electromechanical coin operated dispensing devices, the aforementioned elements may be operated by provision of appropriate electromagnetic drive means.

Assuming, for example, that the levers 13–15 are coordinated to coin values e.g. $1.00, $2.00 and $5.00, then it is possible to select gears having the following number of teeth:

Gear 16: 10 teeth
Gear 24: 20 teeth
Gear 27: 40 teeth
Gear 31: 10 teeth
Gear 34: 50 teeth.

It is clear from this that the ratios of transmission in the gear transmissions have a relation of 1:2:5.

The operation of the hereinbefore described coin counter is substantially as follows:

Prior to a sale, the counting wheel 138 is in its zero position. The indication "zero" on the drum 17 is viewable through the window 22. The energy storage devices 122, 129 and 136 are in a condition storing energy and each of the cams 18–21 is set for a particular selling price.

Assuming that a $1.00 coin is inserted, this enters into the coin chamber for $1.00 coins after passing through the coin tester and there depresses the lever of this chamber in downward direction, so that the short lever arm 107 of this lever tilts the free end of the anchor 109 in such a manner that one hook 114 thereof moves out of engagement with the wheel 116 whereas its other hook 115 engages the wheel 116. This causes the wheel 116 to advance by one step corresponding to half a tooth division under the force exerted upon it by the rack 122. As soon as the coin drops off the lever, the same is returned under the force of the spring 113. At the same time, the anchor 109 returns to its starting position also, which causes the wheel 116 to perform another step corresponding to half a tooth division. In other words, the total distance traveled by the wheel 116 as a result of the insertion of a coin corresponds to one tooth. The clutch 119 and the gear 21 correspondingly turn the wheel 138 and the number "one" of the drum 17 becomes visible in the window 22. The cams 18–21 have also been advanced by one step via the summing shaft 139. During the advancement of the gear 121 via the wheel 116, the overrunning clutches 128 and 135 maintain the other wheels and 131 in uncoupled condition.

If further $1.00 coins are inserted, the already described steps are repeated. The indicating drum 17 shows the numeral "three" after three $1.00 coins have been inserted, and so forth. If one of the cams 18–21 is so set that the selling price corresponds to $3.00, then the appropriate lever engages the cam and releases the associated dispensing component for removal of the item of goods by the purchaser.

If a $2.00 coin were to be inserted, then the wheel 124 is advanced by one tooth in the manner already described with reference to the wheel 116 via the associated anchor 110. The wheel 124 is subject to the force exerted by the rack 129 and the spring 130 thereof. The gear 120 and thus the gear 121 are turned via the gear 127. Based upon the previously described transmission ratio, the counter wheel 138 is turned thereby through an angle which is double the angle through which it is turned if it is driven by the wheel 116. If the driving drive is affected via the train 110, 124, 128, 120 and 121 the over-clutches 119 and 135 disengage the other wheels 116 and 131.

The same is true for the train 111, 131, 133, 134, 135, 120 and 121 which would be triggered for operation by insertion of a $5.00 coin (assuming that such a coin existed). On insertion of a $5.00 coin the counting wheel 138 would be turned through an angular distance which would be five times the distance through which it is turned by operation of the wheel 116. In each and every case the sum of the values of all coins which have been inserted can be viewed on the drum 17 through the window 22.

If dispensing of an item has been released via one of the levers 63–66, then the counter can be reset. For this purpose, the lever 142 is tilted so that the gear 138 is disengaged from the gear 121. The lever 141, which otherwise does not engage the heart shaped cam 140, now presses against the same so that the drum 17 and the cams 18–21 are returned to their starting or zero position by the summing shaft 139. The energy storing devices 122,123; 129,130; and 136,137 associated to the individual gear trains are tensioned for energy storage by means of the slide 49. The racks 122, 129 and 136 are so constructed and mounted that they uncouple from the corresponding gears 118, 125 and 132 during their energy storing movement. The slide 149, just like the lever 142 and the lever 23, can be driven via the dispensing components of the device. However, the lever 23, the lever 142 and the slide 49 can also be operated by electromechanical means or else by a suitable handle which is to be operated by a user of the coin operated dispenser.

Many other modifications and embodiments of the invention can be realized without departing from the scope and intent of the invention. This is particularly true with respect to the construction of the gear trains. It is not necessary for the gear 124 to have a number of teeth which is different from that of the gears 116 and 131. What is important is that during a to and fro movement of one of the anchors 109, 110 or 11 the rotary movement released thereby is so transmitted to the counting wheel 138 by transmission ratios corresponding to the ratios between the different acceptable coin values, that in the case of higher-value coins the wheel 138 turns to a correspondingly larger angle. In place of the several energy storing devices described hereinbefore, a single energy storing device could be used which is associated with all of the gear trains. If such a single energy storing device is to be used, then this may be so arranged, for example, that it acts directly upon the counting wheel or the summing shaft. During each release of one of the anchors the counting wheel then turns to a corresponding angle. In this case, the energy storing device is tensioned for energy storing purposes with the summing shaft 139 uncoupled. The zero position of the drum 17 is so selected that it exists when the energy storing device is fully tensioned. In that case the cam track 40 can be omitted. Resetting of the drum 17 and of the cams is then effected simultaneously with the storing of energy in the energy storing device. It will be appreciated that if more than three different coin values are to be acceptable in the coin operated dispenser, a correspondingly larger number of gear trains is to be used.

It will further be understood that with the coin counter according to the invention compound selling prices, for example, $1.20, can also be set. In this case the dime coin would be the lowest acceptable coin value which causes a one step advancement of the counting wheel. If in such an instance the structurally necessary diameter of the indicating drum and of the cams becomes too large, then each decimal point of the selling price may have associated with it its own indicating drum and cam, and in this case these must be connected with stepping wheels which are known per se from counters and of which each wheel advances the next one by one step after itself having counted steps.

The invention has hereinbefore been described with reference to exemplary embodiments. However, as already pointed out, it is susceptible of a host of modifications all of which are intended to be encompassed within the scope of the appended claims.

We claim:

1. In a coin-operated dispensing device of the type having a plurality of counting cams which can be set to reflect the selling price of items to be dispensed and are rotated in response to the insertion of coins into the device, control rods for setting the selling price of the desired items, a dispensing device for the selected items, and a blocking rod movable from a normal blocking position to a release position permitting dispensing of the selected items in response to the insertion of coins having a value corresponding to the selected selling price, a combination comprising a plurality of movable sensing members each cooperating with one of said cams; a slide member normally holding said blocking rod in said blocking position and being movable to a disengaging position by any one of said sensing members; and a plurality of control levers each connected with one of said control rods and being pivotable thereby in front of said slide member into and out of the path of movement of a respective one of said sensing members; means for counting the inserted coins, including a sum-forming shaft; and means for rotating said cams in response to the insertion of coins, including a plurality of advancing levers, retarding elements each associated with one of said advancing levers and each including a retarding wheel, mechanical energy-storing means coupled to at least one of said wheels, a plurality of transmissions each coupling one of said advancing levers with said sum-forming shaft and said transmissions having relative to one another respective transmission ratios corresponding to the value ratios of coins which can be accepted by said device, and means for furnishing mechanical energy to said energy-storing means for storage by the same, said energy-storing means driving and operating said wheels and levers when actuated by said coins, said coins having kinetic energy less than the amount required to drive and operate said wheels and levers, the energy required for driving and operating said levers being supplied by said energy-storing means.

2. A combination in said dispensing device as defined in claim 1, wherein said device comprises n-control rods, $2^n$ sensing members and $2^n-1$ control levers, at least some of said control levers including entraining portions operative to entrain and move others of said control levers into and out of said paths of movement.

3. A combination in said dispensing device as defined in claim 1, said control rods including a first and a second control rod, said sensing members comprising four sensing members and said control levers including three control levers, the control lever associated with the sensing member coordinated to the lowest item selling price being entrained in response to movement of the control lever coordinated with the next higher as well as in response to movement of the control lever coordinated with the highest selling price.

4. A combination in said dispensing device as defined in claim 1, further comprising a pivotable pawl having a contact surface facing sensing members and control edges cooperating with said blocking rod, said contact surface maintaining said sensing members remote from said cams and from said control levers when blocking rod is in said blocking position thereof.

5. A combination in said dispensing device as defined in claim 4, one of said control edges cooperating with said blocking rod to move said sensing members away from said cams in response to partial movement of said blocking rod towards said release position thereof.

6. A combination in said dispensing device as defined in claim 1; further comprising means biasing said sensing members towards said cams, and means biasing said slide member out of said disengaging position.

7. A combination in said dispensing device as defined in claim 1, said control rods including a first and a second control rod, said sensing members comprising four sensing members and said control levers including three control levers, the control lever associated with the sensing member coordinated to the lowest item selling price being entrained in response to movement of the control lever coordinated with the next higher as well as in response to movement of the control lever coordinated with the highest selling price; a pivotable pawl having a contact surface facing sensing members and control edges cooperating with said blocking rod, said contact surface maintaining said sensing members remote from said cams and from said control levers when blocking rod is in said blocking position thereof; one of said control edges cooperating with said blocking rod to move said sensing members away from said cams in response to partial movement of said blocking rod towards said release position thereof; means biasing said sensing members towards said cams, and means biasing said slide member out of said disengaging position; said counting means further comprising a counting wheel fixedly mounted on said sum-forming shaft for rotation therewith and including an indicating drum and a plurality of adjustable cam discs; and gear means coupling said retarding wheels with said counting wheel; coupling lever means operative for uncoupling said sum-forming shaft from said gear means; said advancing levers each having a lever arm which is short with reference to the length of the respective advancing lever and engages a respective one of said retarding elements; and further comprising a plurality of springs each biasing one of said retarding elements and thereby the advancing lever connected to the same.

8. A combination in said dispensing device as defined in claim 1, said counting means further comprising a counting wheel fixedly mounted on said sum-forming shaft for rotation therewith and including an indicating drum and a plurality of adjustable cam discs; and gear means coupling said retarding wheels with said counting wheel.

9. A combination in said dispensing device as defined in claim 8; and further comprising coupling lever means operative for uncoupling said sum-forming shaft from said gear means.

10. A combination in said dispensing device as defined in claim 1, said advancing levers each having a lever arm which is short with reference to the length of the respective advancing lever and engages a respective one of said retarding elements; and further comprising a plurality of springs each biasing one of said retarding elements and thereby the advancing lever connected to the same.

* * * * *